United States Patent [19]

Gallaher

[11] Patent Number: 4,962,895

[45] Date of Patent: Oct. 16, 1990

[54] MACHINE FOR SHAVING ICE

[76] Inventor: Harold D. Gallaher, Wallen Rd., Bismarck, Mo. 63624

[21] Appl. No.: 330,820

[22] Filed: Mar. 30, 1989

Related U.S. Application Data

[62] Division of Ser. No. 180,902, Apr. 13, 1988.

[51] Int. Cl.[5] ..... B02C 19/12

[52] U.S. Cl. ..... 241/101.2; 83/356.3; 83/701; 241/DIG. 17

[58] Field of Search ..... 83/701, 356.3; 241/285 R, 285 A, 282.1, 282.2, 92, 101.2, DIG. 17; 4/625, 629, 638, 639, 640, 641, 642, 650, 653, 284

[56] References Cited

U.S. PATENT DOCUMENTS

| | | | |
|---|---|---|---|
| 475,052 | 5/1892 | Brahe | 4/625 |
| 1,974,025 | 9/1934 | Harmon . | |
| 2,485,314 | 10/1949 | Ragolio . | |
| 2,486,824 | 11/1949 | Daniels | 4/625 X |
| 2,712,842 | 7/1955 | Fahrni . | |
| 3,032,087 | 5/1962 | Rodwick . | |
| 4,113,190 | 9/1978 | Fundman . | |
| 4,369,532 | 1/1983 | Houchins et al. | 4/639 X |
| 4,593,863 | 6/1986 | Mordstein et al. . | |

*Primary Examiner*—Joseph M. Gorski

*Attorney, Agent, or Firm*—Shoemaker and Mattare, Ltd.

[57] ABSTRACT

An ice shaving machine in which a blade for shaving ice is adjustably supported by a blade mounting and adjustment plate for adjustment of the depth of penetration of the blade into a slot and thus into the ice, and is also adjustable to level the blade across the slot. A unique drain system is also provided, in which at least one air gap is provided between the ice receptacle and a drain tube to prevent migration of molds, bacteria and the like into the ice receptacle from the drain tube. A drive motor is connected through a drive shaft for direct driving engagement with an impeller, and serially arranged plural moisture seals are associated with the shaft to prevent movement of moisture along the shaft to the motor.

5 Claims, 8 Drawing Sheets

MACHINE FOR SHAVING ICE

This is a division of Ser. No. 180,902, filed 4-13-88, now pending.

FIELD OF THE INVENTION

This invention relates to machines for comminuting foods. More particularly, the invention relates to a machine for shaving ice, such as used in the production of confections, for example.

PRIOR ART

A variety of machines and devices are known in the prior art for comminuting foods in general, and for shaving ice in particular. Such ice shaving machines are typically used in the production of confections, commonly called "snow-balls". These prior art machines typically attach a cutting head directly onto an electrical motor or, in some instances, a gasoline engine, for direct drive of the mechanism at a speed of about 2,000 rpm. In most cases, however, drive from the motor to the mechanism is through some type of speed reduction system, such as belts and pulleys or gears and the like. Such prior art arrangements require space for the components, an extra shaft for the final drive, maintenance and adjustment programs for the owner, and an increased possibility of breakdown during a busy time. Moreover, there is also a greater possibility of contamination of the ice or other food being processed because of these added components and need for using oil, grease and the like.

In addition, the mounting of the cutting blade in prior art devices either does not permit adjustment of the blade position, or adjustment is very imprecise, or removal and cleaning of the blade and its mounting components is difficult and time-consuming to accomplish. These considerations are important, since only a very slight movement of the blade position can have a drastic effect on the consistency of the shaved ice produced with the machine. For instance, an improperly sharpened blade will not function properly, or a blade which is out of alignment or tilted will shave only on one side. In addition, even an inaccurately produced blade or blade mounting bracket or other associated part can cause the machine to function ineffectively. Further, most jurisdictions have laws and regulations governing the frequency and thoroughness of cleaning of the machine components. It is commonly required, for example, to at least partially disassemble and clean the machine each day—especially the portions thereof, such as the blade, which come into contact with the food product, such as ice, being processed.

There is also some evidence which suggests that molds and other contaminants, such as harmful bacteria and the like, may grow inside a damp drain hose and that these contaminants will eventually migrate into the food chambers of the machine through the drainage systems used in conventional machines. It is also essential that moisture from condensation or melting ice and the like be kept from the motor. Moreover, the drain hoses on most prior art machines are routed from the machine in a position in full view of consumers, a situation considered by many to be unsightly.

Examples of some prior art machines are described in the following U.S. Pat. Nos.: 1,974,025, 2,485,314, 2,712,842, 3,032,087, 4,113,190 and 4,593,863. U.S. Pat. No. 1,974,025 has a reduction gear drive and fixed blades. U.S. Pat. No. 2,485,314 uses a belt and pulley drive system and also has fixed blades. U.S. Pat. No. 2,712,842 also uses a belt and pulley drive system, and clamps the blade by a plate 71 and screws. Adjustment may be possible with this structure, but would be very difficult to accomplish accurately. U.S. Pat. No. 3,032,087 is concerned with a food slicer-shredder, and has fixed blades. U.S. Pat. No. 4,593,863 relates to a device for chopping up garden waste and the like and has fixed blades or knives and an exposed drive motor. U.S. Pat. No. 4,113,190 describes an ice shaving machine in which the blades are fixed (preset at the factory), and in which a direct drive is used between the motor and the mechanism.

SUMMARY OF THE INVENTION

Accordingly, it is an object of this invention to provide a machine for comminuting food, and especially for shaving ice, in which the cutting blade is mounted for easy and accurate adjustment.

Another object is to provide a machine for shaving ice, in which the cutting blade is mounted for quick and easy removal for cleaning.

A further object of the invention is to provide a machine for shaving ice, in which the cutting blade is mounted so as to permit side-to-side or tilting adjustment along the length of the blade as well as depth adjustment.

A still further object is to provide a machine for shaving ice, in which a direct drive is provided between the motor and the mechanism, and plural seals are provided to protect the motor from moisture.

Yet another object is to provide a machine for shaving ice, in which an air gap is established in the drains for conveying moisture away from the machine, thereby creating a barrier to migration of molds, bacteria and the like along the drain and into the food containing area.

The foregoing objects as well as other objects and advantages of the invention are accomplished by a machine in which a motor is supported in a housing and is connected through an extended shaft for direct driving relationship with a rotating impeller. The motor is positioned beneath the impeller in a preferred embodiment, and is supported on a motor mounting plate having a raised lip around the shaft for preventing drainage or dripping of condensed moisture onto the motor. A "slinger" is also carried on the shaft above the mounting plate for rotation with the shaft and functions to sling any moisture away that may tend to drain downwardly along the shaft. In addition, a bearing seal is positioned on the shaft above the slinger for supporting the shaft and also for effecting a seal against migration of food (ice, etc.) along the shaft from the processing chamber.

The processing chamber is supported at the top of the machine and includes a basin in which the impeller is rotatably supported. A slotted opening is formed through the floor of the basin and a cutting blade projects into the opening to shave ice supported in the basin and rotated by the impeller. The cutting blade is mounted through a unique tripod arrangement which enables a tilting or side-to-side adjustment of the blade to be made, as well as a depth adjustment. Thus, compensation can be made for imperfections in sharpening and/or manufacturing tolerances of the blade and associated components; and, the operator can have precise control over the position of the blade, enabling a variety of textures to be quickly and easily selected for the shaved ice. Moreover, a single knob is used for attaching the blade and its adjustment mechanism to the basin floor, whereby the blade and its associated components can be quickly and easily removed and replaced for cleaning or other purposes.

The basin, or at least the basin floor, is tilted very slightly toward the rear of the machine, and a drain or weep hole is provided through the floor for draining away melted ice or other collected moisture. An upper drain receptacle is positioned beneath the rear portion of the basin to catch moisture draining through the weep opening or condensing on the outside of the basin, and a drain hose leads from the drain receptacle. A drain pan is supported at the bottom of the machine in a position to be below a container used to catch ice shaved by the blade in the upper basin, and has a sloping floor for conveying any melted ice to a drain opening toward the rear of the drain pan. A drain hose is connected with this drain opening for conveying the collected moisture away from the machine. The drain hose from the upper drain receptacle extends into proximity with the lower drain pan and discharges moisture drained from the upper basin into the lower drain pan for subsequent removal through the lower drain hose. The upper drain hose is spaced above the lower drain pan, thereby establishing an air gap in the drainage path from the upper basin to final discharge. Moreover, the drain pan positioned beneath the upper basin establishes an air gap between the upper drain hose and the interior of the basin or the food processing chamber. Consequently, molds and/or bacteria and the like cannot migrate along the drain hoses and into the food processing chamber.

As used herein, it is to be understood that although the machine of the invention has been designed and is intended for use to shave ice, the principles of the invention could also be applied in the design of a machine for comminuting other food products, and such use is intended to be covered.

BRIEF DESCRIPTION OF THE DRAWINGS

These and other objects and advantages of the invention will become apparent from the following detailed description when considered with the accompanying drawings, in which like reference characters designate like parts throughout the several views, and wherein.

DETAILED DESCRIPTION OF THE PREFERRED EMBODIMENT

Referring now more particularly to the drawings, an ice shaving machine in accordance with the invention is indicated generally at 10. The machine includes a base or pedestal 11, an upstanding support post or column 12 and an upper, food processing chamber 13.

Figure 3:
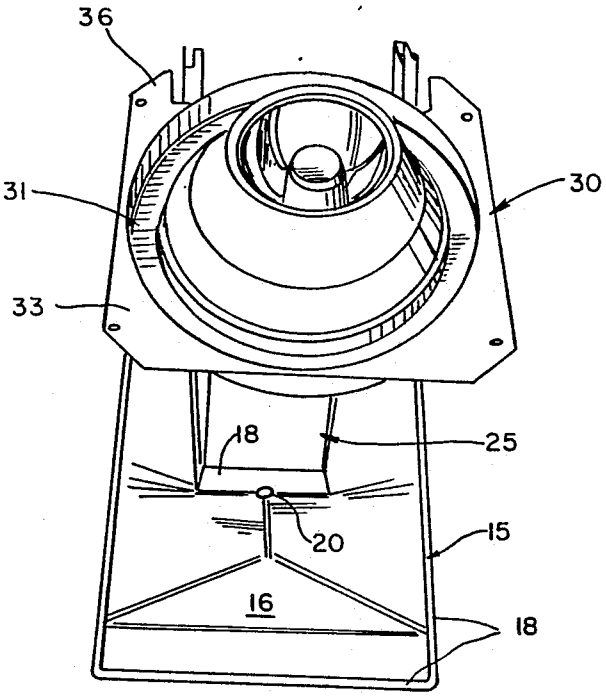
FIG. 3 is a front view looking down on the machine of FIG. 1, with the cabinetry or housing removed and showing the upper basin, impeller and lower drain pan.
Figure 6:
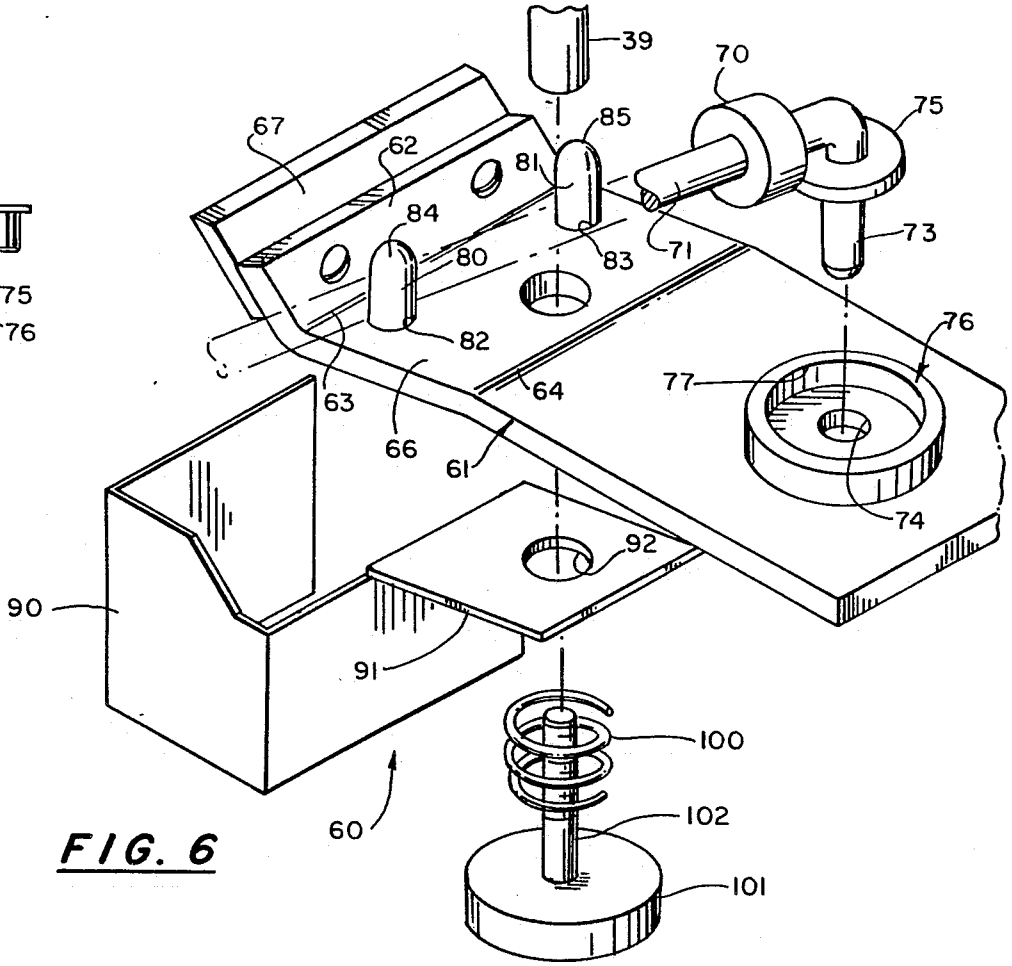
FIG. 6 is a greatly enlarged, fragmentary exploded view of the cutting blade and its mounting and adjustment means removed from the machine.
Figure 5:
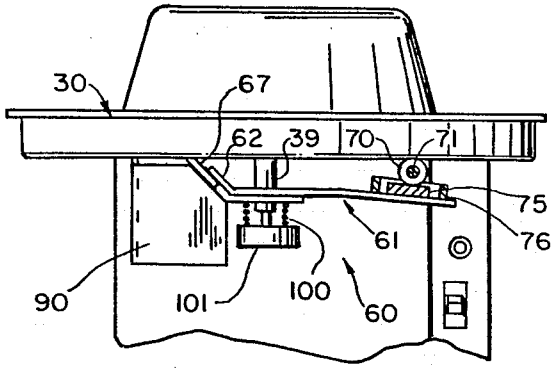
FIG. 5 is a fragmentary, front view in elevation, on a slightly reduced scale, of the upper portion of the machine, with the housing or cover removed, showing the relationship of the cutting blade mounting and adjustment means and the upper basin and impeller.
Figure 7:
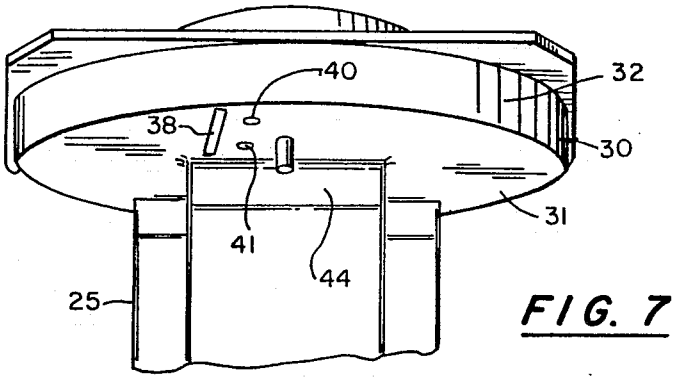
FIG. 7 is fragmentary, front perspective view looking up at the underside of the upper basin with the cover or housing and the cutting blade and its mounting and adjustment means removed.
Figure 8:
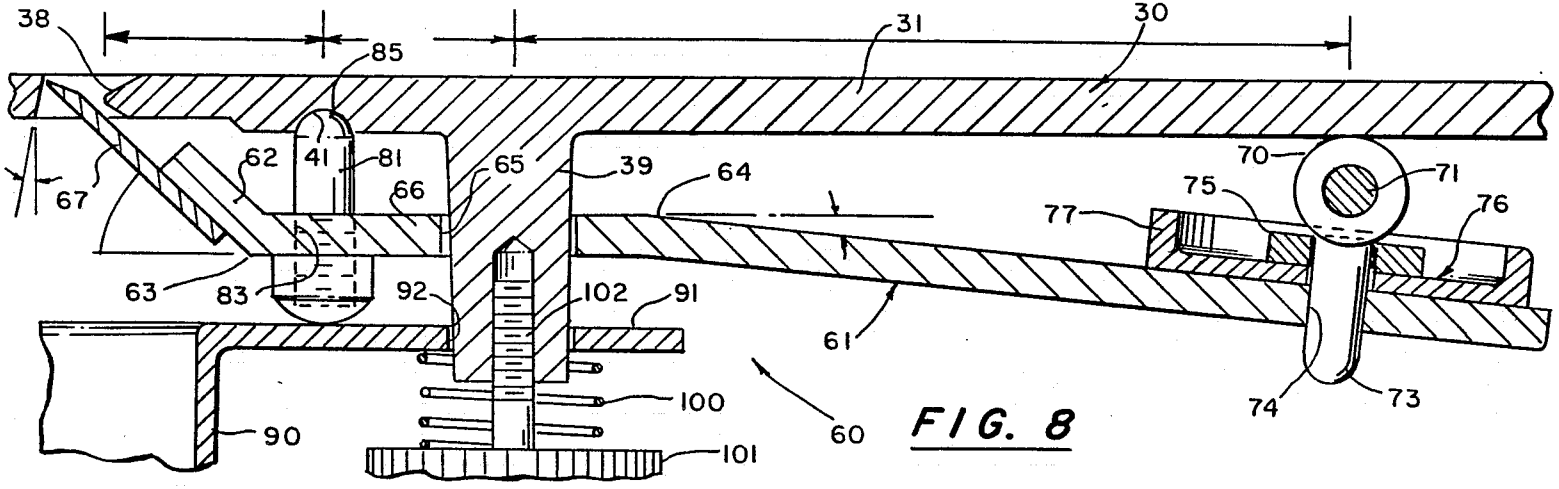
FIG. 8 is a greatly enlarged fragmentary view in section of a portion of the floor of the upper basin and the cutting blade and its mounting and adjustment means.
Figure 10:
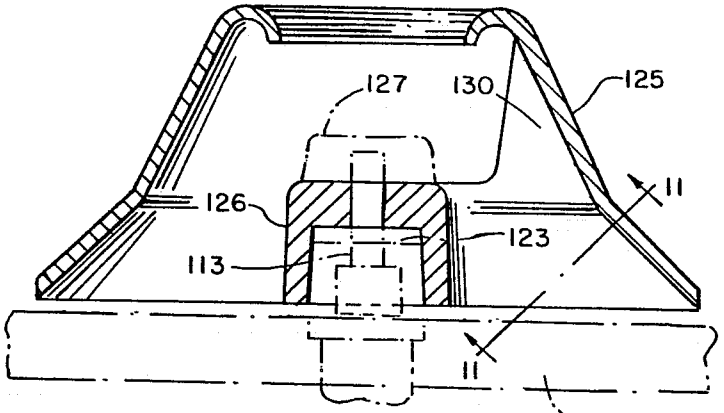
FIG. 10 is a transverse sectional view taken along line 10—10 in FIG. 9.
Figure 11:
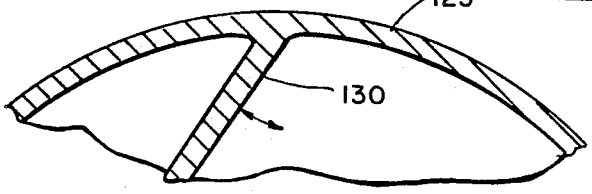
FIG. 11 is a fragmentary sectional view taken along line 11—11 in FIG. 10.
Figure 9:
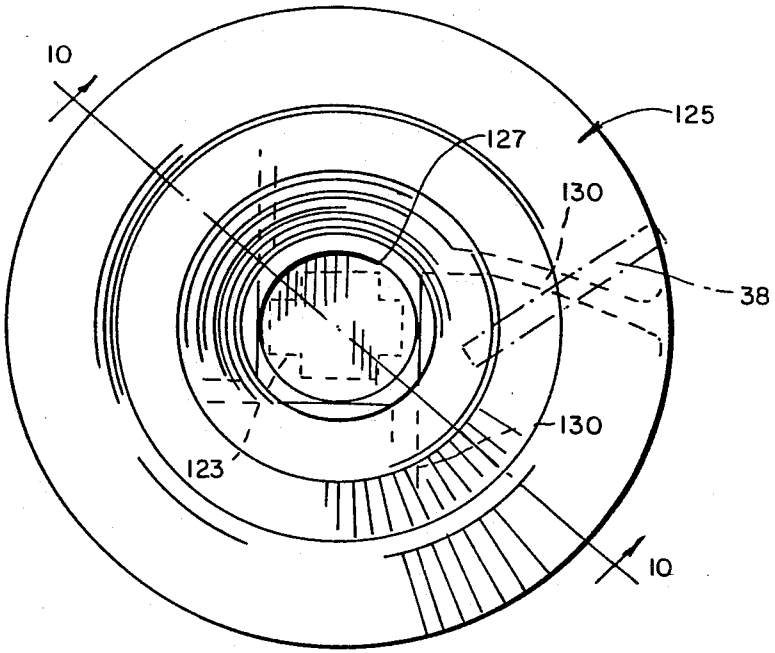
FIG. 9 is a somewhat schematic top plan view of the impeller of the invention.
Figure 13:
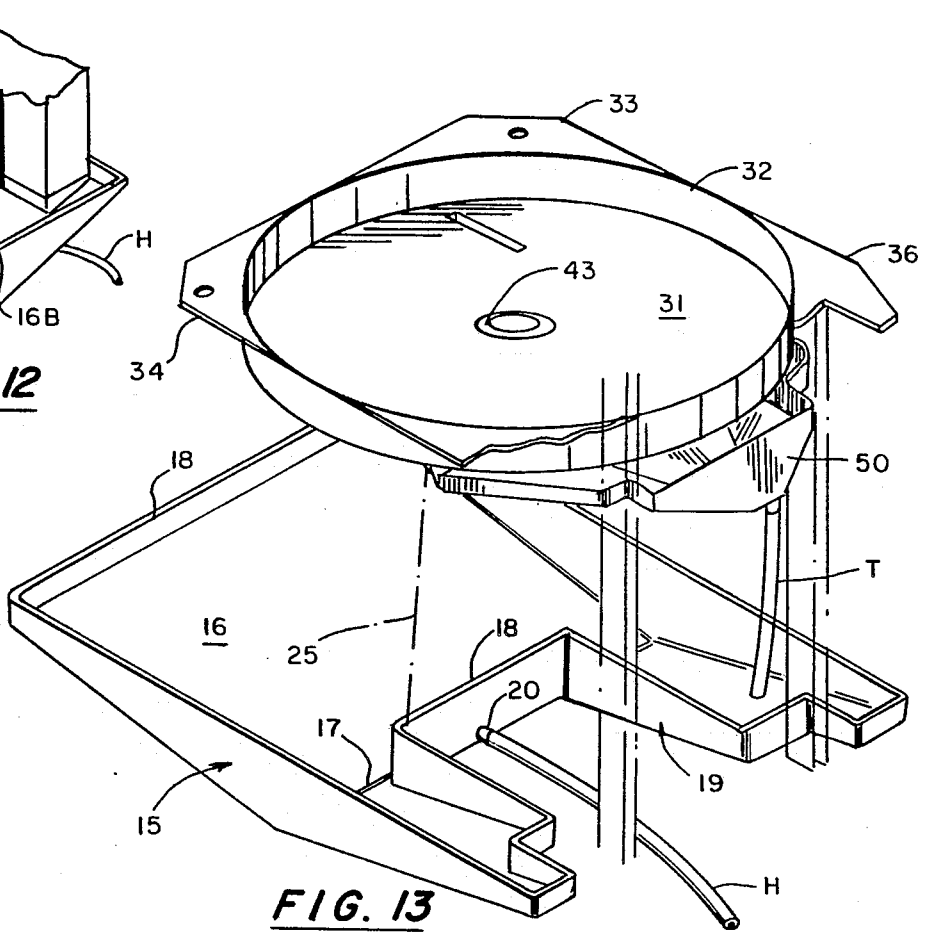
FIG. 13 is a schematic, rear perspective view showing the upper basin, upper drain receptacle and drain hose, and lower drain pan and drain hose used in the machine of the invention.
Figure 12:
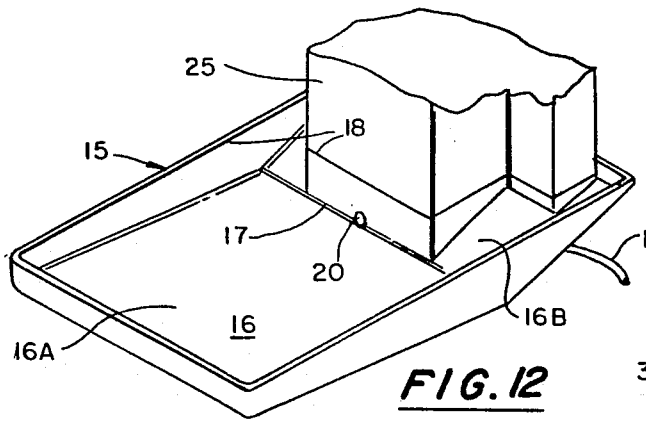
FIG. 12 is a fragmentary, front perspective view looking down on the bottom drain pan, with the housing or cover removed.

Referring first to FIGS. 3 and 12–13, the base comprises a drain pan 15 with the floor 16 having a first portion 16A sloping downwardly and rearwardly, and a second portion 16B sloping downwardly and forwardly toward a lowest portion 17 disposed immediately in front of the support post 12. An upstanding wall or flange 18 is formed around the periphery of the drain pan to define a reservoir for holding a quantity of collected moisture. As seen best in FIGS. 13 and 14, the rear portion 19 of the pan 15 is shaped to conform to the outline of the support post 12. A drain opening 20 is formed through the flange 18 at the lowest portion 17 for removing any melted ice or other moisture collected in the pan 15, and a drain hose "H" is connected with the drain opening for conveying collected moisture to a suitable disposal site. It should be noted that all corners of the pan are smooth and rounded to facilitate cleaning. While the pan 15 may be made from any suitable material, and in accordance with any suitable manufacturing technique, it is preferably constructed from a metal casting.

Figure 14:
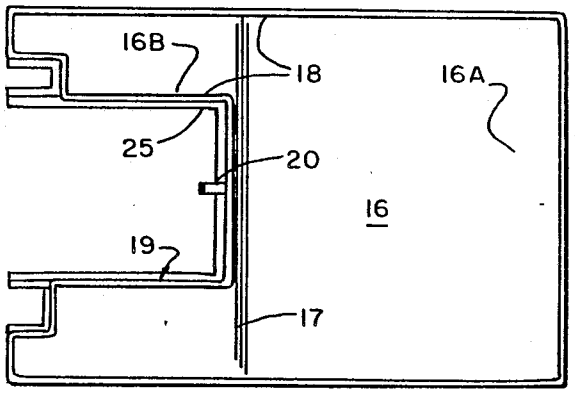
FIG. 14 is a top plan view, on a somewhat reduced scale, of the lower drain pan.
Figure 15:
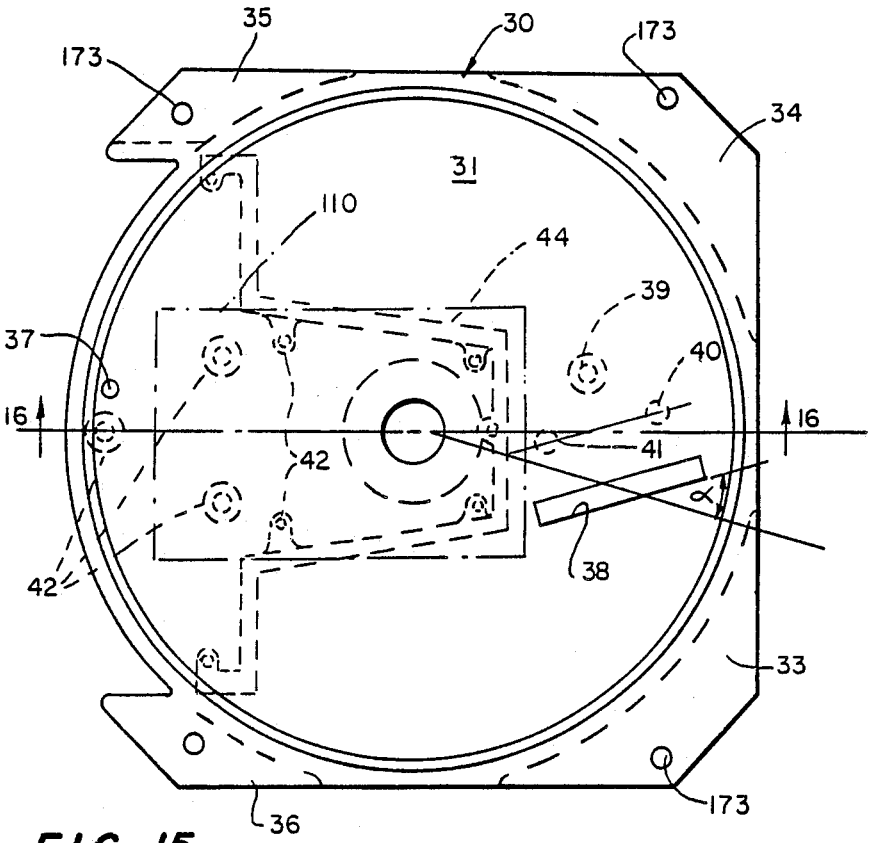
FIG. 15 is a plan view of the basin, showing the relationship of the position of the cutting blade to the center of rotation of the impeller, and showing the positioning of the motor mounting means.
Figure 16:
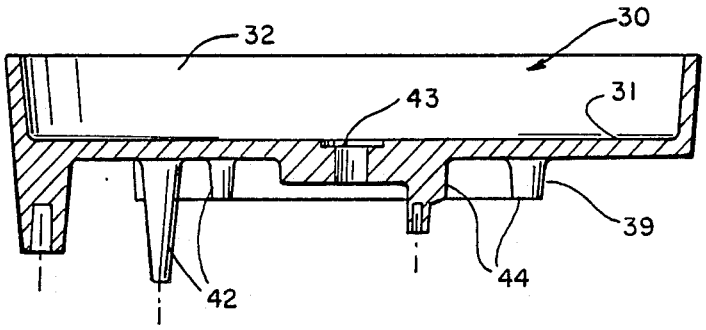
FIG. 16 is a transverse sectional view of the basin, taken along line 16—16 in FIG. 15.
Figure 17:
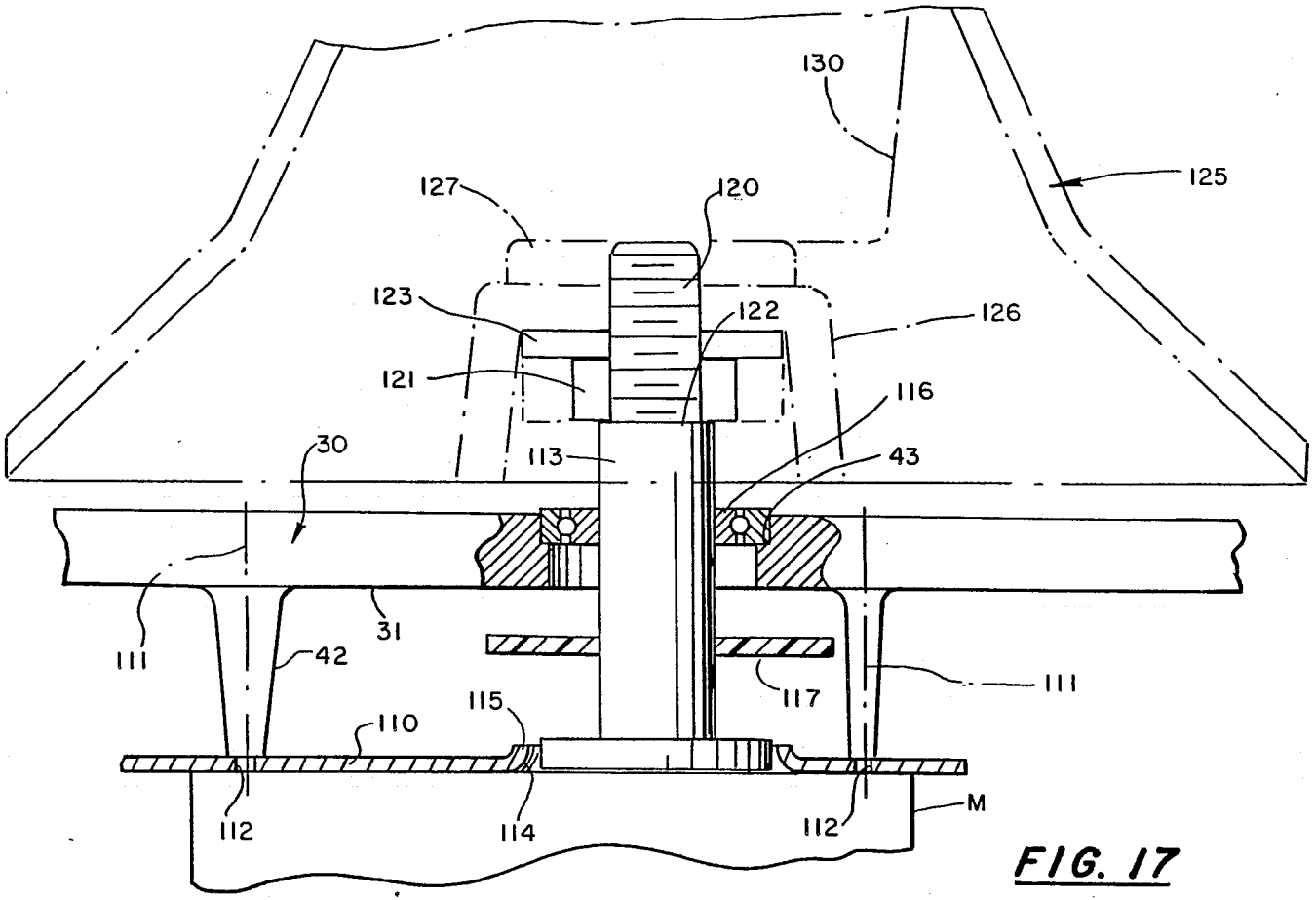
FIG. 17 is a greatly enlarged, fragmentary sectional view of a portion of the motor, impeller and drive shaft sealing arrangement used in the invention.

The post 12 preferably comprises a sheet metal stamping 25, having substantially a U-shape in transverse cross-section, and is suitably affixed to the drain pan in the shaped area at the rear of the pan, as shown in dot-and-dash lines in FIG. 13 and as seen in FIGS. 3, 12 and 14. The motor "M" (FIG. 17), wiring and other controls (not shown) are confined and supported within the stamping 25 of support post 12.

As seen best in FIGS. 3–5, 7 and 13, the food processing chamber 13 comprises an ice receptacle or basin 30 of circular configuration in plan view and having a bottom wall 31 and upstanding cylindrical side wall 32. Shaped corner flanges 33, 34, 35 and 36 are formed at the top of the side wall 32 and a drain opening 37 is formed through the bottom wall at the rear of the basin. The basin is sloped rearwardly a slight amount (3°, for example) to cause any moisture in the basin to drain toward the drain opening 37.

Additionally, and with particular reference to FIGS. 4, 7, 13, 15 and 16, an elongate slot 38 is formed through the bottom wall 31 near the front of the basin. In a preferred embodiment, the longitudinal axis of the slot subtends an angle of about 30° with respect to a radius of the basin extended through the slot, and this radius is offset about 15° from the centerline CL of the basin. Further, a blade mounting post 39 is formed on the underside of the basin in predetermined spaced relationship to the slot along a line drawn perpendicularly through the center of the longitudinal axis of the slot, and a pair of shallow depressions 40 and 41 are formed in the underside of the basin bottom wall 31 in spaced relationship between the post and slot. Motor mounting posts 42 and a bearing boss 43 are also formed in the bottom of the basin. As seen best in FIGS. 7, 15 and 16, the basin is supported at the top of the support post stamping 25 by a shaped flange 44 integrally formed on the underside of the basin. The basin may be made of any suitable material and in accordance with any suitable manufacturing technique, but preferably comprises a metal casting.

The unique drainage system for the machine of the invention is represented best in FIG. 13. As seen in this figure, a drain receptacle 50 is supported beneath the rear portion of the basin 30 in a position to catch moisture flowing through the drain opening 37, and is shaped to also catch condensed moisture dripping from the basin. A drain tube "T" is connected with the drain receptacle for conveying fluid collected therein to the rear portion of the drain pan 15. Clearly, there is an air space between the basin 30 and the drain receptacle 50, and also between the lower end of the drain tube "T" and the pan 15. Fluid collected in the drain pan is then conveyed to a point of disposal via drain hose "H" as described earlier. The relationship of drain openings and tubes is such that the tubes may be conveniently hidden from view, if desired.

The unique blade mounting and adjustment system 60 is shown in FIGS. 1, 2 and 4–8. As seen in these figures, an elongate, generally rectangularly shaped blade mounting plate 61 has a first end 62 bent upwardly at about a 45° angle along line 63. Approximately onethird the distance from said first end toward end, the plate is bent downwardly at an angle of about 5° along a line 64. An opening 65 is formed through a generally horizontally extending portion 66 of the plate extending between the two bend lines, and is positioned nearer the bend line 64. As seen best in figure 8, the plate is received over the mounting post 39 on the upper basin, with the post extending through the opening 65, and the generally horizontally extending portion 66 lying parallel to the plane of the basin bottom wall 31.

A rectangular blade 67 is secured on the upwardly bent end 62, in a position to extend into the slot 38 in the bottom wall 31 of the basin 30.

Adjustment of the depth of extension of the blade into the slot is accomplished by a roller 70 rotationally carried on a shaft 71 having a handle 72 projecting beyond the front of the machine (see FIGS. 1 and 2), and a pivot 73 bent downwardly at a right angle to the shaft 71 and extending through an opening 74 in the plate 61. A washer-like bushing 75 is fixed on the pivot 73 to limit the downward movement of the pivot through the opening 74 and to position the roller 70 against the underside of the basin bottom wall 31. A cup-shaped guide 76 is secured on top of the plate concentrically with the opening 74 and has an upstanding rim 77 around its periphery to engage the side of the roller and prevent its movement outwardly along the shaft 71 toward the handle. The bushing 75 engages the roller on its other side to limit inward movement of the roller along the shaft 71 toward the pivot. Thus, the position of the roller on the shaft is accurately maintained, and movement of the handle from left to right as viewed in FIGS. 1 and 4 will cause the roller 70 to move farther out on the plate 61, away from the blade, while movement of the handle in the opposite direction will cause the roller to move inward on the plate, toward the blade.

Side-to-side or tilting adjustment of the plate, and thus the blade, to level the blade edge with the plane of the slot 38, is accomplished with a pair of tilt adjustment screws 80 and 81 extended through a pair of spaced apart openings 82 and 83 formed through the portion 66 near the bend line 63 and on opposite sides of the longitudinal center line of the plate. These screws have rounded ends 84 and 85, respectively, which are received in the shallow depressions 40 and 41 formed in the underside of the basin bottom wall 31. By adjustment of the screws in their openings, the tilt of the plate and blade can be adjusted. Further, the screws comprise or define a pivot line about which the plate is pivoted by movement of the handle 72 and roller 70 as described previously, adjusting the depth of penetration of the blade into the slot 38.

A shield or deflector 90 is supported on the mounting post 39 by means of a rectangular attachment flange 91 having an opening 92 therethrough in which the post 39 is received. The shield prevents ice shaved by the blade from spewing through the slot 38 in an uncontrolled shower. With the shield, the shaved ice is constrained to move into a container (not shown) held under the area of the slot 38.

The plate, blade, shield and associated components thus described are held on the mounting post 39 with the roller 70 and adjustment screws 80 and 81 firmly in contact with the basin wall 31 by means of a coil spring 100 disposed concentrically on the post 39 and held compressed between the shield attaching flange 91 and a knob 101 with a threaded shaft 102 extended into the end of the post. As should be apparent, the entire blade assembly can be quickly and easily removed from the machine for cleaning by simply removing the knob 101. Thereafter, the roller and its associated components may simply be lifted out of the opening 74 in the plate 61.

Referring to FIGS. 4, 9–11 and 15–17, details of the motor mounting means, drive connection from the motor to the impeller and drive shaft seal means can be seen. The motor "M" is mounted on an adapter plate 110 by screws, bolts or other suitable fastening means 111 extended through the motor mounting posts 42 formed on the basin 30 and through aligned openings 112 in the plate 110 into the motor casing or housing. A stainless steel drive shaft 113 extends from the motor and through an opening 114 in the adapter plate 110 with a raised annular lip 115 around it.

The shaft 113 is supported and sealed relative to the basin bottom wall 31 by a sealed stainless steel bearing 116 seated on bearing boss 43. The bearing 116 serves both as a moisture seal and an upper shaft support. A rubber washer 117 is placed around the shaft 113 between the bearing 116 and adapter plate 110, and functions to sling any moisture away from the shaft which might leak past the bearing 116. Thus, the bearing seal 116, washer 117 and lip 115 define a three-tier, plural seal to prevent moisture from reaching the motor.

The upper end of the shaft 113 is threaded at 120 and carries a hex nut 121 against the shoulder 122 formed between the shaft and threaded end 120. A square or cross-shaped drive nut 123 is next threaded onto the shaft into engagement with the hex nut, and an inverted bowl shaped impeller 125 with a shaped hub 126 is placed over the shaft and drive nut. A cap nut 127 is then threaded onto the end of the drive shaft, clamping the impeller between the cap nut and the drive nut. The impeller has a plurality of generally radially extending vanes 130 for impelling ice cubes (not shown) in a circular path on top of the basin bottom wall 31 and past the blade 67 to shave ice from the cubes. The shaved ice is then discharged through the slot to a suitable container held or positioned beneath the deflector shield 90. The angular relationship of the slot 38 and blade 67 to the impeller is shown in dot-and-dash lines in FIG. 9. The impeller may be easily lifted from the machine after removing the cap nut 127.

Figure 2:
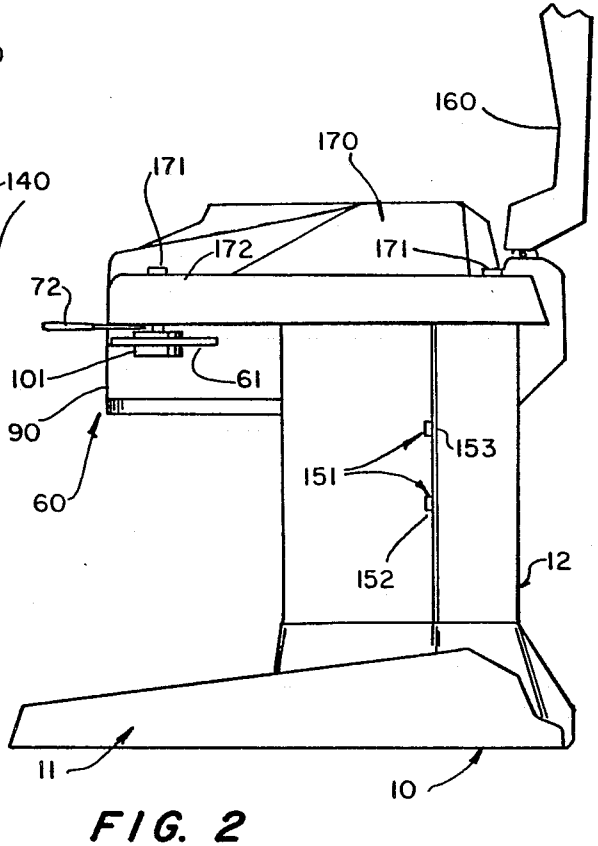
FIG. 2 is a side view in elevation, with the lid opened, of the machine of FIG. 1.
Figure 1:
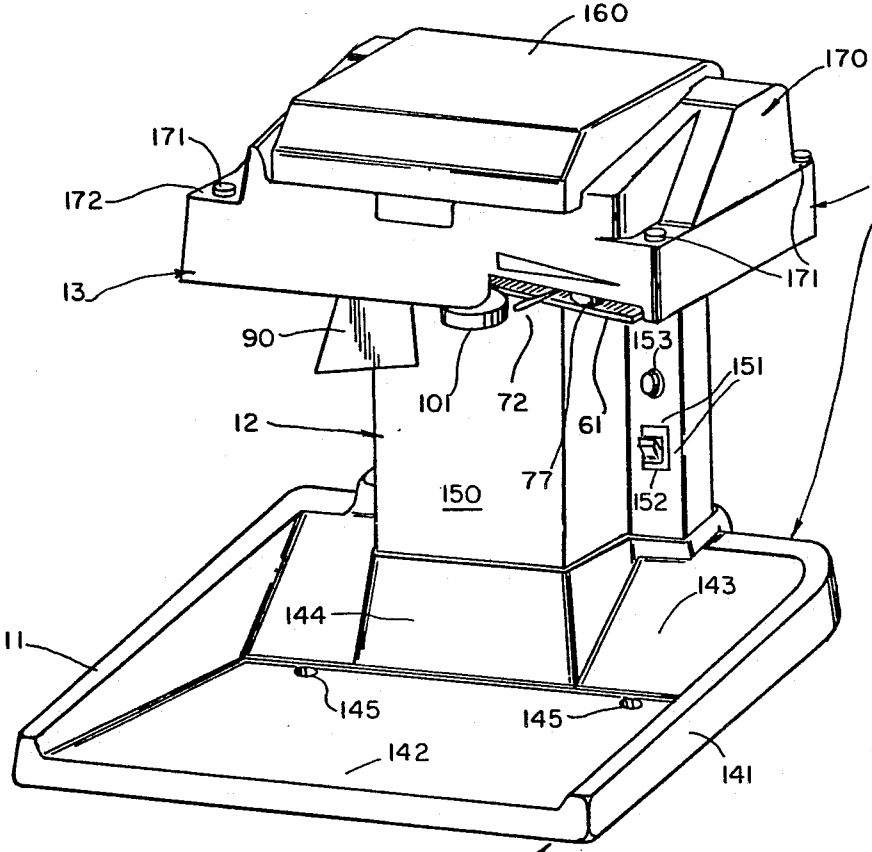
FIG. 1 is a top, front perspective view of the machine of the invention.
Figure 4:
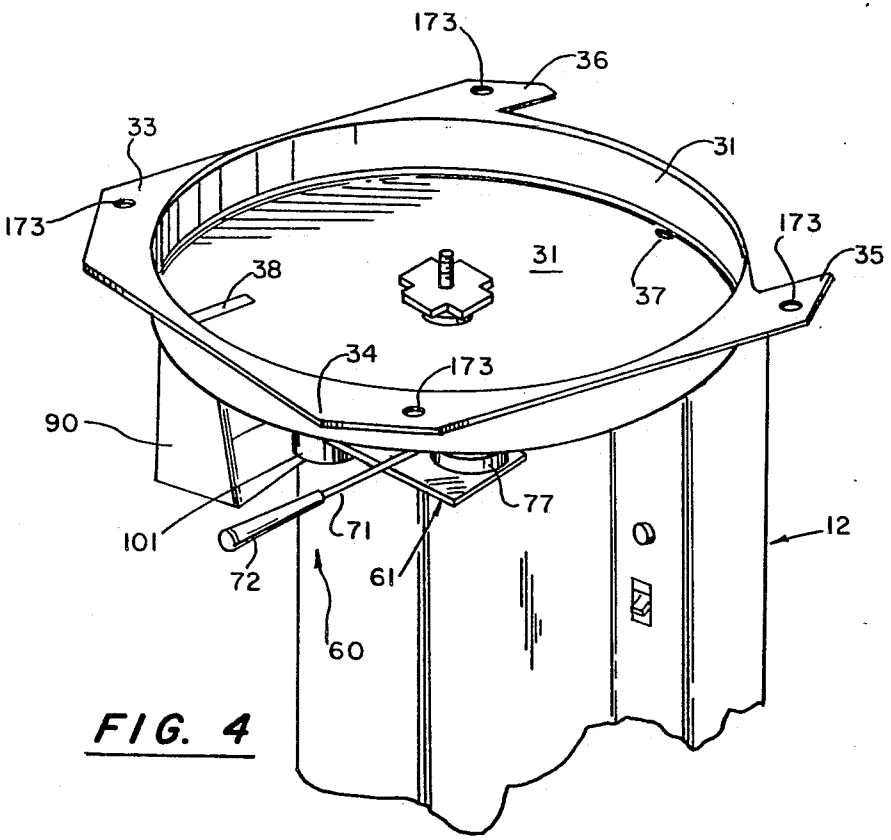
FIG. 4 is an enlarged, fragmentary perspective view of the upper basin, with the impeller and housing or cover removed.

The entire structure is enclosed in a housing 140 formed of plastic or other suitable material. As seen in FIGS. 1 and 2, the housing 140 includes a lower drain tray and cover 141 which fits over the metal drain pan 16. The drain tray 141 is shaped to conform generally with the contours of the drain pan 16, and includes a rearwardly sloping front bottom portion 142 and a forwardly sloping rear bottom portion 143. An upstanding flange 144 extends upwardly over the lower portion of the post, and one or more drain openings 145 are formed through the lowest portion of the tray to drain any moisture collected therein to the underlying drain pan 16 and thence to the drain hose "H". The drain tray may be lifted off of the machine to empty any accumulated ice therein.

The post is similarly covered with a housing 150. As seen in FIGS. 1 and 2, control switches 151 are provided on a front surface of the post at one side thereof. These control switches may include, for example, an on-off switch 152 and a reset switch 153. In addition, a foot-operated switch (not shown) may be provided in the power supply cord (not shown). Further, an interlock switch (not shown) is preferably provided in association with the lid 160 arranged to close over the impeller, whereby the machine cannot be actuated with the lid open.

The housing 170 for covering the basin 30 and impeller 125 is secured in place by a plurality of fasteners 171 extended through flat portions 172 of the housing and into aligned openings 173 in the flanges 33, 34, 35 and 36 on the basin 30. These fasteners may be quickly and easily removed whereby the cover 170 may be lifted off, exposing the ice receptacle, impeller and associated components.

The machine constructed in accordance with the above is aesthetically pleasing and is easy to disassemble and clean. It also provides easy and precise control over the consistency of the ice shaved, and includes means for preventing contamination due to migration of molds, bacteria and the like from the drainage system back into the food processing chamber. Further, the position of the drain enables the drain hose to be routed in any direction, insuring that it can be kept out of sight. All controls are easily seen and accessible from the front of the machine, and the machine occupies a minimum amount of counter space. As seen in FIG. 2, the lid 160 remains within the "footprint" of the machine when the lid is open, rendering it unnecessary to position the machine away from a wall or other obstacle.

The unique construction of the blade mounting and adjusting means provides a long "lever" for more precise control over positioning of the blade upon a given amount of movement of the roller, and the use of the roller with the relatively long lever creates a mechanical advantage which enables the blade to dislodge any ice which may become jammed in the slot. The roller mechanism on the blade adjustment also eliminates any wear due to sliding motion. Still further, the adjustment described herein permits the use of indicia on the front of the machine so that the operator can select a desired consistency or coarseness of the shaved ice, and a predetermined maximum setting can be selected by adjusting the leveling screws 80 and 81, whereby movement of the handle 72 to its maximum setting will not exceed a predetermined desired consistency.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. An ice shaving machine, comprising:

a frame having a base for supporting the machine on a supporting surface, an upstanding pedestal projecting upwardly from one side of the base, and a top supported on the pedestal so as to overlie the base in upwardly spaced relationship thereto;

said top including an ice receptacle supported on the pedestal for holding a quantity of ice to be shaved, said ice receptacle having a bottom with a first opening therethrough for discharge of shaved ice through the bottom of the ice receptacle, and further having a drain opening for draining melted ice away from the receptacle;

ice shaving blade means projecting into the ice receptacle for shaving ice placed therein;

a drain receptacle supported beneath the ice receptacle in position to catch moisture drained through the drain opening, said drain receptacle being disposed in spaced relationship below said ice receptacle and thereby defining a first air gap;

a drain pan supported on said base in spaced relationship below said drain receptacle;

a drain tube leading from the drain receptacle to said drain pan for conducting moisture from said drain receptacle to said drain pan and having a discharge end spaced from said drain pan to define a second air gap, said first and second air gaps functioning to prevent migration to the ice receptacle of molds and bacteria which might from in the drain tubes; and a removable drain tray placed over said drain pan to catch shaved ice, said drain tray having a drain opening therethrough for draining melted ice into the drain pan and being liftable away from said drain pan for disposing of shaved ice collected in said drain tray.

2. The ice shaving machine as claimed in claim 1, wherein:

said ice receptacle bottom is inclined toward said drain opening of said ice receptacle to facilitate drainage of moisture from the ice receptacle.

3. The ice shaving machine as claimed in claim 2, wherein:

a drain hose is connected with said drain pan to conduct moisture away from the drain pan to a drainage system.

4. The ice shaving machine as claimed in claim 3, wherein:

said drain pan has a bottom wall that is generally V-shaped in longitudinal cross-section, and a drain opening at a bottom of said V-shaped wall, said drain hose being connected to said drain opening.

5. The ice shaving machine as claimed in claim 4, wherein:

said drain tray is shaped complementally to said drain pan so as to overlie the same in nested, conforming relationship thereto.

* * * * *